US011480370B2

(12) United States Patent
Yoshii et al.

(10) Patent No.: US 11,480,370 B2
(45) Date of Patent: Oct. 25, 2022

(54) EVAPORATOR AND REFRIGERATION MACHINE

(71) Applicant: MITSUBISHI HEAVY INDUSTRIES THERMAL SYSTEMS, LTD., Tokyo (JP)

(72) Inventors: Taichi Yoshii, Tokyo (JP); Yasutaka Aoki, Tokyo (JP); Takeshi Kaneko, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 120 days.

(21) Appl. No.: 16/963,175

(22) PCT Filed: Dec. 4, 2018

(86) PCT No.: PCT/JP2018/044542
§ 371 (c)(1),
(2) Date: Jul. 17, 2020

(87) PCT Pub. No.: WO2019/146265
PCT Pub. Date: Aug. 1, 2019

(65) Prior Publication Data

US 2021/0123644 A1 Apr. 29, 2021

(30) Foreign Application Priority Data

Jan. 26, 2018 (JP) ..... JP2018-011798

(51) Int. Cl.
*F25B 39/02* (2006.01)

(52) U.S. Cl.
CPC ..... *F25B 39/028* (2013.01)

(58) Field of Classification Search
CPC combination set(s) only.
See application file for complete search history.

(56) References Cited

U.S. PATENT DOCUMENTS 3,095,255 A 6/1963 Smith et al.
6,293,112 B1 * 9/2001 Moeykens ..... F28D 3/04 62/84

(Continued)

FOREIGN PATENT DOCUMENTS

CN 2253460 Y 4/1997
CN 2426119 Y 4/2001

(Continued)

OTHER PUBLICATIONS

Written Opinion of the International Searching Authority and International Search Report, dated Feb. 19, 2019, for International Application No. PCT/JP2018/044542, with English translations.

*Primary Examiner* — Henry T Crenshaw
*Assistant Examiner* — Kamran Tavakoldavani
(74) *Attorney, Agent, or Firm* — Birch, Stewart, Kolasch & Birch, LLP

(57) ABSTRACT

An evaporator (2) is provided with a casing (5), a refrigerant supply section (7), a first heat transfer pipe group (10), and a second heat transfer pipe group (11). The first heat transfer pipe group (10) is disposed in the lower part of the space in the casing (5) so as to be immersed in the refrigerant and comprises a plurality of heat transfer pipes (12) through which liquid to be cooled flows. The second heat transfer pipe group (11) is provided in the space in the casing (5) at a position below the refrigerant supply section (7) and above the liquid level of the refrigerant, and comprises a plurality of second heat transfer pipes (13) through which liquid to be cooled flows.

4 Claims, 7 Drawing Sheets

(56) References Cited

U.S. PATENT DOCUMENTS

| | | | | |
|---|---|---|---|---|
| 2007/0017243 | A1* | 1/2007 | Kidwell | C10L 3/10 165/45 |
| 2010/0319395 | A1 | 12/2010 | de Larminat et al. | |
| 2014/0366574 | A1 | 12/2014 | Christians et al. | |
| 2015/0053378 | A1* | 2/2015 | Numata | F28D 7/16 165/157 |

FOREIGN PATENT DOCUMENTS

| | | | |
|---|---|---|---|
| EP | 0 843 139 | A2 | 5/1998 |
| JP | 50-149958 | U | 12/1975 |
| JP | 53-50557 | A | 5/1978 |
| JP | 60-17647 | | 5/1985 |
| JP | 62-186179 | A | 8/1987 |
| JP | 10-160282 | A | 6/1998 |
| JP | 2003-517560 | A | 5/2003 |
| JP | 2004-340546 | A | 12/2004 |
| JP | 2011-80756 | A | 4/2011 |
| JP | 2016-528473 | A | 9/2016 |

* cited by examiner

EVAPORATOR AND REFRIGERATION MACHINE

TECHNICAL FIELD

The invention relates to an evaporator and a refrigeration machine.

Priority is claimed on Japanese Patent Application No. 2018-011798 filed on Jan. 26, 2018, the content of which is incorporated herein by reference.

BACKGROUND ART

As an evaporator used for a refrigeration machine, there is a flooded evaporator in which heat transfer pipes are all immersed in refrigerant liquid as described in PTL 1. In the case of the flooded evaporator, all of the heat transfer pipes need to be immersed and thus the amount of refrigerant liquid to be held inside the evaporator is large.

Meanwhile, in the case of a liquid film-type evaporator described in PTL 2 in which refrigerant liquid flows down to heat transfer pipes from above, a shell does not need to be filled with refrigerant liquid. Therefore, the amount of refrigerant to be held can be reduced, the heat transfer coefficient is increased, and the area of heat transfer (lengths of heat transfer pipes or number of heat transfer pipes) can be reduced.

CITATION LIST

Patent Literature

[PTL 1] Japanese Unexamined Patent Application Publication No. 2004-340546

[PTL 2] PCT Japanese Translation Patent Publication No. 2003-517560

SUMMARY OF INVENTION

Technical Problem

However, in the case of the liquid film-type evaporator described in PTL 2, to exhibit the performance thereof maximally, it is necessary to supply refrigerant liquid, of which the amount is equal to or larger than the amount of evaporation, to the heat transfer pipes. Therefore, a portion of the supplied refrigerant liquid is not evaporated and it is necessary to circulate the refrigerant liquid not evaporated to a position above the heat transfer pipes by means of a pump or the like. Accordingly, the number of components may be increased and there may be an increase in evaporator size and cost.

An object of the invention is to provide an evaporator and a refrigeration machine with which it is possible to reduce the amount of refrigerant liquid to be held and the area of heat transfer while suppressing an increase in size and cost in comparison with a flooded type.

Solution to Problem

According to a first aspect of the invention, there is provided an evaporator including a casing in which a refrigerant is stored and that includes a discharge port for discharging an evaporated refrigerant to an outside, a refrigerant supply section that supplies, from an upper portion of a space in the casing, a refrigerant from the outside, a first heat transfer pipe group that is disposed in a lower portion of the space in the casing so as to be immersed in the refrigerant and is composed of a plurality of first heat transfer pipes through which liquid to be cooled flows, and a second heat transfer pipe group that is disposed in the space in the casing at a position below the refrigerant supply section and above a liquid level of the refrigerant and is composed of a plurality of second heat transfer pipes through which the liquid to be cooled flows.

According to such a configuration, the second heat transfer pipe group disposed at the upper portion can be used as a liquid film-type evaporator and the first heat transfer pipe group disposed at the lower portion can be used as a flooded evaporator. Accordingly, even if a refrigerant, of which the amount is equal to or larger than the amount of evaporation caused by the second heat transfer pipe group, is supplied into the casing, a portion of the refrigerant that is not evaporated can be recovered as a refrigerant of a flooded evaporator. Therefore, it becomes not necessary to circulate a portion of the refrigerant that is not evaporated to the upper portion by means of a pump or the like. As a result, it is possible to reduce the amount of refrigerant liquid to be held and the area of heat transfer while suppressing an increase in size and cost of the evaporator.

According to a second aspect of the invention, in the evaporator related to the first aspect, the second heat transfer pipe group may include a plurality of needle-shaped fins on an outer surface of the second heat transfer pipe disposed at an upper portion from among the plurality of second heat transfer pipes.

According to such a configuration, a liquid film formed on a surface of the second heat transfer pipe including the needle-shaped fins can be made thin. Therefore, the thermal resistance can be made small and the heat transfer coefficient can be made large. Furthermore, the plurality of needle-shaped fins are provided on only the second heat transfer pipe that is disposed at the upper portion and is included in the second heat transfer pipe group, a liquid film on the second heat transfer pipe that is disposed at the lower portion and is included in the second heat transfer pipe group can be restrained from being made excessively thin such that a heat transfer pipe surface is exposed. Therefore, it is possible to suppress a decrease in heat transfer performance in the second heat transfer pipe group.

According to a third aspect of the invention, the evaporator related to the first or second aspect may further include a third heat transfer pipe group composed of a plurality of third heat transfer pipes between the first heat transfer pipe group and the second heat transfer pipe group, and the first heat transfer pipes and the third heat transfer pipes may include boiling heat transfer surfaces on outer surface sides thereof.

According to such a configuration, normally, it is possible to cause the third heat transfer pipes to function as heat transfer pipes of a liquid film-type evaporator together with the second heat transfer pipes. At this time, with boiling heat transfer surfaces of the third heat transfer pipes, it is possible to accelerate boiling on heat transfer pipe surfaces in comparison with a case where no boiling heat transfer surface is provided. Therefore, performance as a liquid film-type evaporator can be improved. In addition, even if the amount of the refrigerant not evaporated in the second heat transfer pipe group is increased and the liquid level of the refrigerant in the casing is raised and the third heat transfer pipe group is immersed in the refrigerant, since the third heat transfer pipes include the boiling heat transfer surfaces, the same heat exchange performance as the heat exchange performance of the first heat transfer pipes can be achieved. That is, the heat exchange performance can be improved in comparison with a case where the third heat transfer pipes include no boiling heat transfer surface.

According to a fourth aspect of the invention, there is provided a refrigeration machine including the evaporator related to any one of the first to third aspects.

According to such a configuration, it is possible to achieve size reduction while suppressing a decrease in heat exchange performance.

Advantageous Effects of Invention

According to the evaporator and the refrigeration machine as described above, it is possible to reduce the amount of refrigerant liquid to be held while suppressing an increase in size.

DESCRIPTION OF EMBODIMENTS

First Embodiment

Next, an evaporator and a refrigeration machine in a first embodiment of the invention will be described with reference to the drawings.

Figure 1:
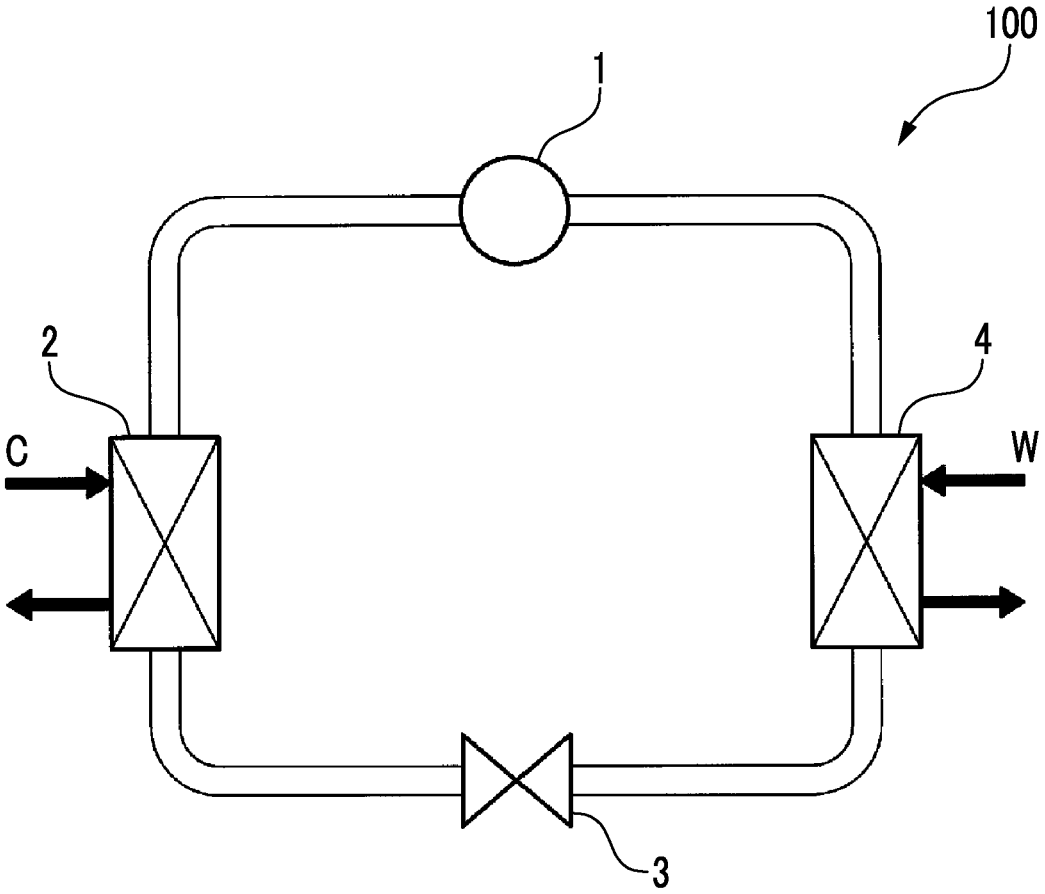
FIG. 1 is a configuration diagram showing a schematic configuration of a refrigeration machine in a first embodiment of the invention.

FIG. 1 is a configuration diagram showing a schematic configuration of the refrigeration machine in the first embodiment of the invention. The refrigeration machine described in the first embodiment is a so-called steam compression type refrigeration machine.

As shown in FIG. 1, a refrigeration machine 100 in the first embodiment includes a refrigerating cycle and includes a compressor 1, an evaporator 2, an expansion valve 3, and a condenser 4 as basic components thereof.

In the refrigerating cycle of the refrigeration machine 100, a high-pressure gaseous refrigerant compressed by the compressor 1 is subjected to heat exchange with cooling water W or the like supplied from the outside by the condenser 4 and condensed. After the pressure of the condensed liquid refrigerant is decreased by the expansion valve 3, the liquid refrigerant flows into the evaporator 2. A two-phase refrigerant flowing into the evaporator 2 returns to the compressor 1 after being evaporated by being subjected to heat exchange with a fluid C to be cooled. The refrigerating cycle of the refrigeration machine 100 is not limited to a basic configuration as described here.

Figure 2:
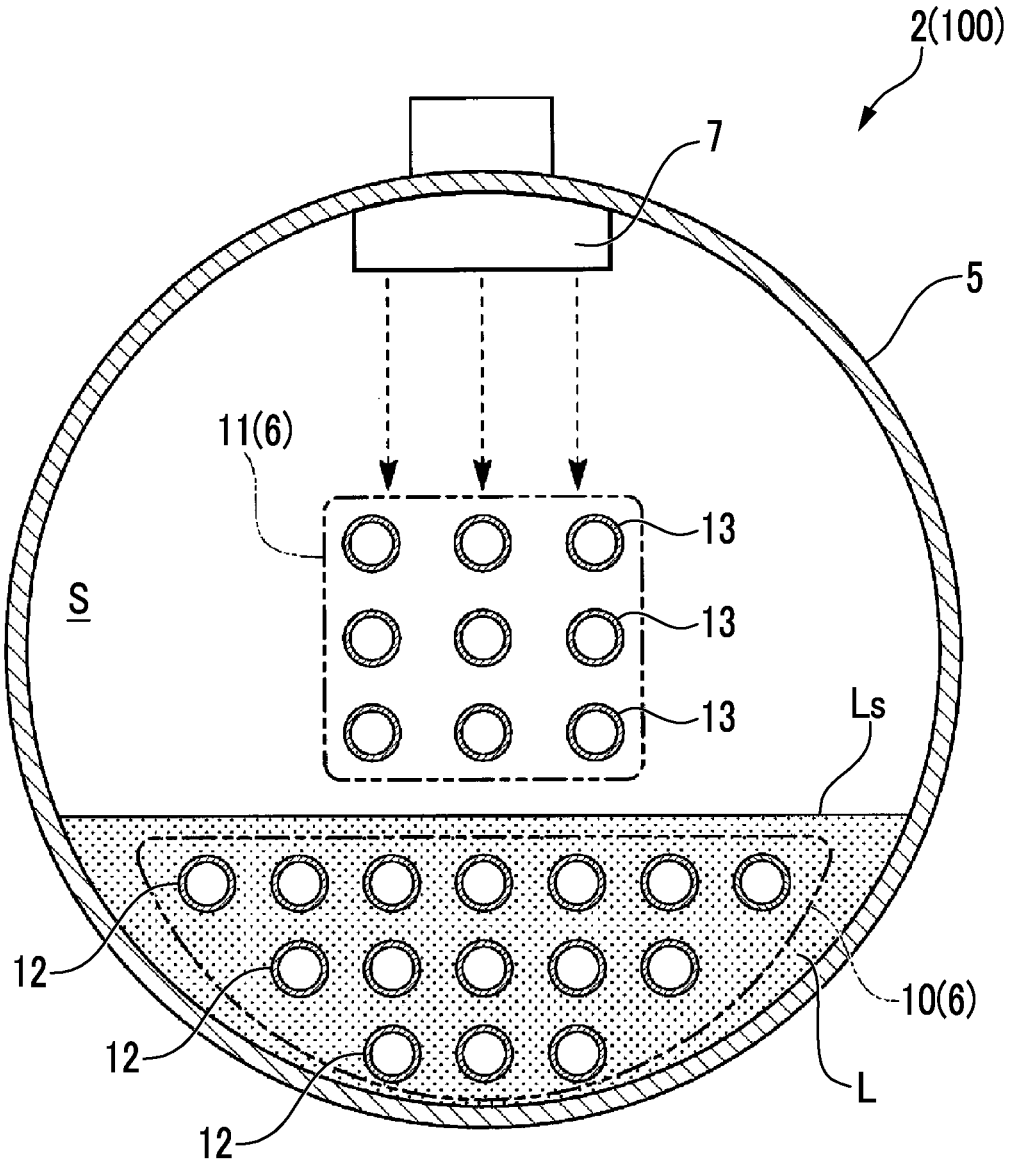
FIG. 2 is a sectional view showing the configuration of an evaporator in the first embodiment of the invention.
Figure 3:
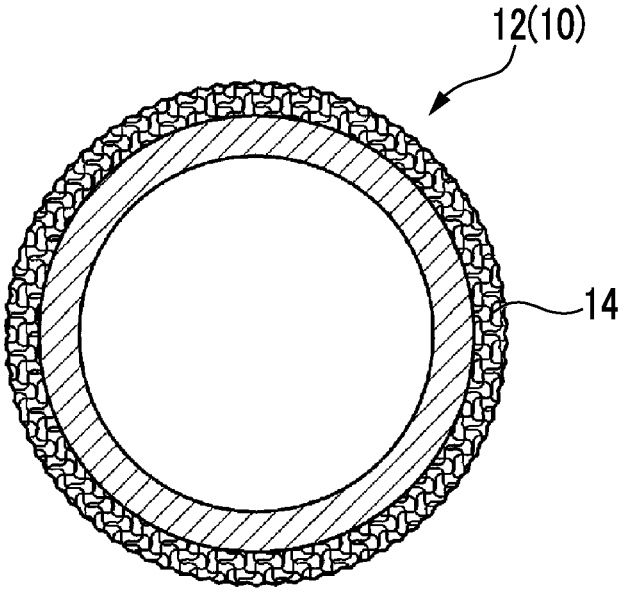
FIG. 3 is a sectional view of a first heat transfer pipe in the first embodiment of the invention.

FIG. 2 is a sectional view showing the configuration of the evaporator in the first embodiment of the invention. FIG. 3 is a sectional view of a first heat transfer pipe in the first embodiment of the invention.

As shown in FIG. 2, the evaporator 2 includes a casing 5, a heat transfer pipe group 6, and a refrigerant supply section 7.

Figure 8:
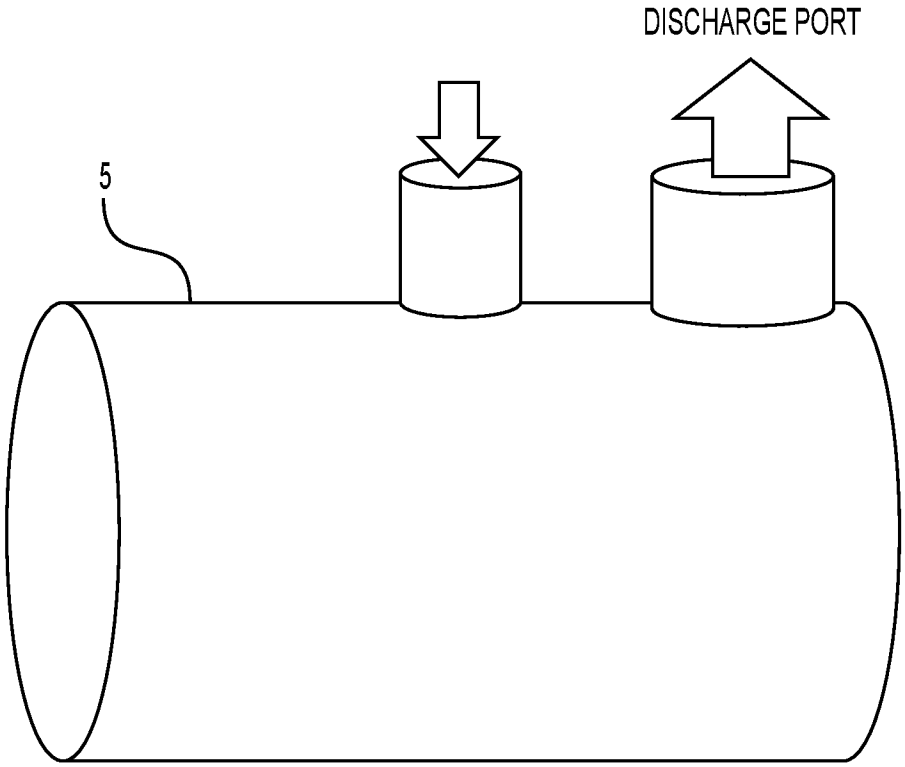
FIG. 8 shows the casing provided with a discharge port.

The casing 5 forms a sealed space S covering the heat transfer pipe group 6 and the refrigerant supply section 7. A refrigerant can be stored in the space S inside the casing 5. The casing 5 is formed with a discharge port (refer to FIG. 8) for discharging evaporated refrigerant to the outside to send the refrigerant toward the compressor 1, an opening (not shown) through which a pipe for supplying a fluid to be cooled and heat transfer pipes (heat transfer pipe group 6) communicate with each other, and an opening (not shown) through which a pipe for supplying a liquid refrigerant and the refrigerant supply section 7 communicate with each other. The casing 5 in the first embodiment is, for example, formed in a tubular shape having a circular cross-sectional contour.

The heat transfer pipe group 6 includes a first heat transfer pipe group 10 and a second heat transfer pipe group 11.

The first heat transfer pipe group 10 is composed of a plurality of first heat transfer pipes 12. The first heat transfer pipe group 10 is provided in a lower portion of the space S in the casing 5, and each of the plurality of first heat transfer pipes 12 extends in a longitudinal direction (front-to-back direction of paper surface of FIG. 2 (in other words, axial direction of tubular shape of casing 5)) of the tubular casing 5. Inside the first heat transfer pipes 12, the fluid C to be cooled that exchanges heat with the refrigerant flows. The first heat transfer pipes 12 constituting the first heat transfer pipe group 10 are disposed to be immersed in a liquid refrigerant L. In other words, these first heat transfer pipes 12 are disposed below a liquid level Ls of the liquid refrigerant L accumulated in the lower portion of the space S in the casing 5. The plurality of first heat transfer pipes 12 constituting the first heat transfer pipe group 10 are disposed at intervals over the entire region in the liquid refrigerant L, the first heat transfer pipes 12 being disposed at substantially equal intervals. Regarding the first heat transfer pipe group 10 in the present embodiment, the first heat transfer pipes 12 are arranged in three rows in a vertical direction with seven first heat transfer pipes 12 being arranged in a horizontal direction at the upper row, five first heat transfer pipes 12 being arranged in a horizontal direction at the middle row, and three first heat transfer pipes 12 being arranged in a horizontal direction at the lower row, respectively. The number of rows, the number of columns, the pitch, and the arrangement (lattice arrangement/staggered arrangement) of the first heat transfer pipes 12 are not limited to the above number.

The first heat transfer pipe 12 is formed of, copper or an alloy containing copper, which is excellent in heat transfer performance, for example. As shown in FIG. 3, the first heat transfer pipe 12 includes a boiling heat transfer surface 14 on an outer surface side thereof. The boiling heat transfer surface 14 can be formed of metal or the like. The boiling heat transfer surface 14 contributes to acceleration of bubble generation when a liquid refrigerant brought into contact with a surface of the first heat transfer pipe 12 boils. Note that, although FIG. 3 shows a porous layer as an example of the boiling heat transfer surface, the boiling heat transfer surface is not limited to a porous layer and various kinds of boiling heat transfer surfaces can be applied.

Figure 4:
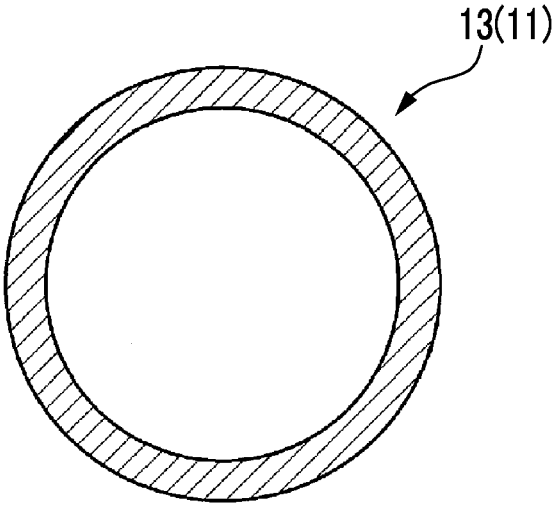
FIG. 4 is a sectional view of a second heat transfer pipe in the first embodiment of the invention.

FIG. 4 is a sectional view of a second heat transfer pipe in the first embodiment of the invention.

As shown in FIG. 2, the second heat transfer pipe group 11 is composed of a plurality of second heat transfer pipes 13. The second heat transfer pipe group 11 is provided above the liquid level Ls of the liquid refrigerant L in the space S in the casing 5. As shown in FIG. 2 and FIG. 4, the second heat transfer pipe 13 constituting the second heat transfer pipe group 11 is formed in a tubular shape having a circular cross-sectional contour and the fluid C to be cooled that exchanges heat with a refrigerant flows therein. The second heat transfer pipes 13 also extend in the longitudinal direction of the casing 5, as with the first heat transfer pipes 12.

The second heat transfer pipe group 11 is disposed below the refrigerant supply section 7. The second heat transfer pipe group 11 in the present embodiment is disposed near the center of the casing 5 in a cross section shown in FIG. 2. In other words, the second heat transfer pipe group is disposed to be separate from the casing 5 in the horizontal direction intersecting a direction in which the second heat transfer pipes 13 extend. Regarding the second heat transfer pipe group 11 described in the present embodiment, three rows of three second heat transfer pipes 13 arranged in the horizontal direction are provided in the vertical direction. The number of rows, the number of columns, the pitch, and the arrangement (lattice arrangement/staggered arrangement) of the second heat transfer pipes 13 are not limited to the above number.

The refrigerant supply section 7 supplies the liquid refrigerant L, which is supplied from the outside via the expansion valve 3, from an upper portion of the space S in the casing 5. Here, it will be assumed that the number of heat transfer pipes installed in the first heat transfer pipe group 10 and the second heat transfer pipe group 11 is set such that the entire liquid refrigerant L supplied from the refrigerant supply section 7 can be evaporated. Accordingly, since the entire supplied refrigerant liquid is evaporated, the position of the liquid level Ls is maintained above the first heat transfer pipe group 10.

The refrigerant evaporated by the first heat transfer pipe group 10 and the second heat transfer pipe group 11 described above is supplied to the compressor 1 via the discharge port (not shown) provided in the upper portion of the casing 5.

That is, in the above-described evaporator 2, the liquid refrigerant L that has passed through the second heat transfer pipe group 11 without being evaporated and that is a portion of the liquid refrigerant L supplied by the refrigerant supply section 7 stays at the lower portion of the casing 5 due to the own weight thereof and is evaporated by the first heat transfer pipe group 10 without returning to the upper portion of the casing 5. In addition, the refrigerant evaporated by being brought into contact with the first heat transfer pipe group 10 is also discharged via the discharge port provided in the upper portion of the casing 5 described above.

Therefore, according to the above-described first embodiment, the first heat transfer pipe group 10 disposed at the lower portion of the space S can be used as a flooded evaporator and the second heat transfer pipe group 11 disposed at the upper portion can be used as a liquid film-type evaporator. Accordingly, even if the liquid refrigerant L, of which the amount is equal to or larger than the amount of evaporation caused by the second heat transfer pipe group 11, is supplied into the casing 5, a portion of the liquid refrigerant L that is not evaporated can be recovered as a refrigerant of a flooded evaporator by being evaporated. Therefore, it becomes not necessary to circulate a portion of the liquid refrigerant L that is not evaporated to the refrigerant supply section 7 in the upper portion by means of a pump or the like.

As a result, it is possible to reduce the amount of the liquid refrigerant L to be held and the area of heat transfer while suppressing an increase in size and cost of the evaporator 2.

Second Embodiment

Next, an evaporator and a refrigeration machine in a second embodiment of the invention will be described with reference to the drawings. Since the second embodiment is different from the above-described first embodiment only in terms of the configuration of the second heat transfer pipe group, the same parts as those in the first embodiment will be given the same reference numerals.

Figure 5:
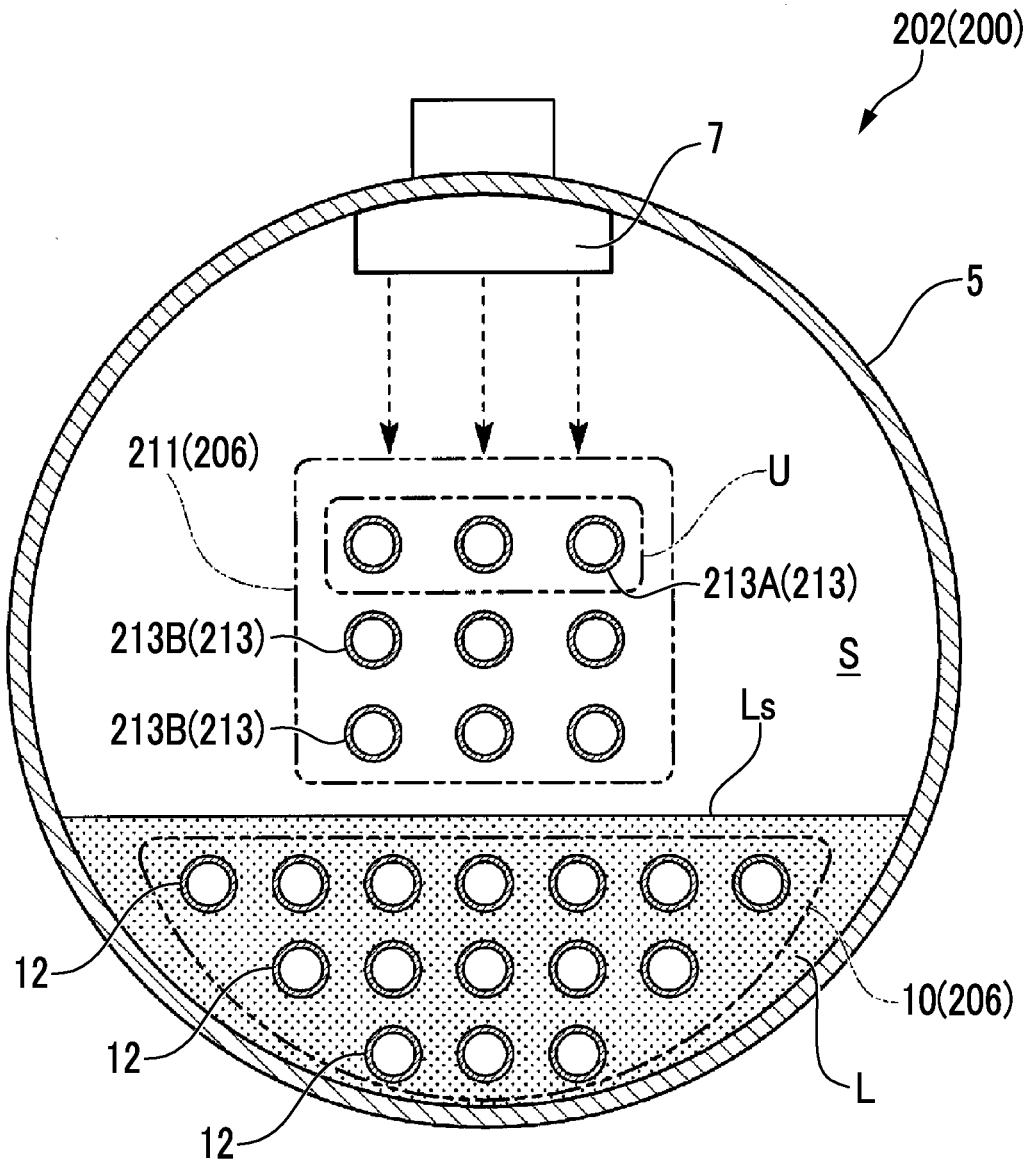
FIG. 5 is a sectional view showing an evaporator in a second embodiment of the invention and corresponds to FIG. 2.
Figure 6:
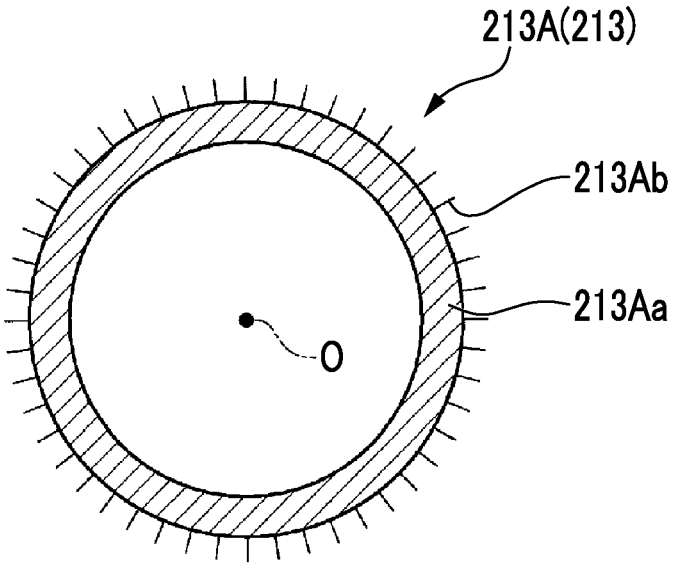
FIG. 6 is a sectional view of a second heat transfer pipe that is disposed at an upper portion and is included in a second heat transfer pipe group in the second embodiment of the invention.

FIG. 5 is a sectional view showing the evaporator in the second embodiment of the invention and corresponds to FIG. 2. FIG. 6 is a sectional view of a second heat transfer pipe that is disposed at an upper portion and is included in a second heat transfer pipe group in the second embodiment of the invention.

A refrigeration machine 200 in the second embodiment includes the compressor 1, the condenser 4, the expansion valve 3, and an evaporator 202 as with the above-described first embodiment. Note that, the detailed description of the entire configuration of the refrigeration machine 200 of the second embodiment will be omitted because the description overlaps with that of the first embodiment.

As shown in FIG. 5, the evaporator 202 includes the casing 5, a heat transfer pipe group 206, and the refrigerant supply section 7.

The casing 5 forms a sealed space S covering the heat transfer pipe group 206 and the refrigerant supply section 7, as with the casing 5 in the first embodiment. A refrigerant can be stored in the space S inside the casing 5. The casing 5 is formed with a discharge port (not shown) for discharging evaporated refrigerant to the outside to send the refrigerant toward the compressor 1, an opening (not shown) through which a pipe for supplying a fluid to be cooled and heat transfer pipes (heat transfer pipe group 206) communicate with each other, and an opening (not shown) through which a pipe for supplying the liquid refrigerant L and the refrigerant supply section 7 communicate with each other.

The heat transfer pipe group 206 includes the first heat transfer pipe group 10 and a second heat transfer pipe group 211.

The first heat transfer pipe group 10 has the same configuration as the first heat transfer pipe group 10 in the first embodiment and is composed of the plurality of first heat transfer pipes 12. The first heat transfer pipes 12 are provided at a lower portion of the space S in the casing 5 and extend in the horizontal direction in parallel. Inside the first heat transfer pipes 12, liquid to be cooled that exchanges heat with the liquid refrigerant L flows. The first heat transfer pipes 12 constituting the first heat transfer pipe group 10 are provided to be immersed in the liquid refrigerant L. The first heat transfer pipes 12 constituting the heat transfer pipe group 206 are disposed at intervals over the entire region in the liquid refrigerant L, the first heat transfer pipes 12 being disposed at substantially equal intervals. Regarding the first heat transfer pipe group 10 in the second embodiment as well, as with the first embodiment, the first heat transfer pipes 12 are arranged in three rows in a vertical direction with seven first heat transfer pipes 12 being arranged in a horizontal direction at the upper row, five first heat transfer pipes 12 being arranged in a horizontal direction at the middle row, and three first heat transfer pipes 12 being arranged in a horizontal direction at the lower row, respectively. The number of rows, the number of columns, the pitch, and the arrangement (lattice arrangement/staggered arrangement) of the first heat transfer pipes 12 are not limited to the above number.

The first heat transfer pipe 12 is formed of, copper or an alloy containing copper, which is excellent in heat transfer performance, for example. In addition, as with the first embodiment, the first heat transfer pipe 12 includes the boiling heat transfer surface 14 (refer to FIG. 3) on an outer surface side thereof.

The second heat transfer pipe group 211 is composed of a plurality of second heat transfer pipes 213. The plurality of second heat transfer pipes 213 are formed of the same metal as the first heat transfer pipes 12. The plurality of second heat transfer pipes 213 include finned second heat transfer pipes (hereinafter, simply referred to as "finned heat transfer pipes 213A") and finless second heat transfer pipes (hereinafter, simply referred to as "finless heat transfer pipes 213B"). The finned heat transfer pipes 213A are disposed above the second heat transfer pipe group 211 only and the finless heat transfer pipes 213B are disposed below the finned heat transfer pipes 213A. Regarding the second heat transfer pipe group 211 described in the second embodiment, three rows of three second heat transfer pipes 213 arranged at intervals in the horizontal direction are provided in the vertical direction. Furthermore, regarding the second heat transfer pipe group 211 in the second embodiment, three second heat transfer pipes 213 disposed at an uppermost row U from among the plurality of second heat transfer pipes 213 are the finned heat transfer pipes 213A. The finned heat transfer pipes 213A are disposed immediately below the refrigerant supply section 7 and is most likely to come into contact with the liquid refrigerant L supplied by the refrigerant supply section 7. The number of rows, the number of columns, the pitch, and the arrangement (lattice arrangement/staggered arrangement) of the second heat transfer pipes 213 are not limited to the above number.

As shown in FIG. 6, the finned heat transfer pipe 213A includes a heat transfer pipe body 213Aa and a plurality of needle-shaped fins 213Ab. The heat transfer pipe body 213Aa is formed in a tubular shape having a circular cross-sectional contour, as with the second heat transfer pipe 13 of the first embodiment. The needle-shaped fins 213Ab are formed in a needle-shape extending from an outer peripheral surface of the heat transfer pipe body 213Aa toward an outer side in a radial direction around an axis O of the heat transfer pipe body 213Aa. The plurality of needle-shaped fins 213Ab are formed at slight intervals in a circumferential direction and a longitudinal direction of the heat transfer pipe body 213Aa. That is, the needle-shaped fins 213Ab are formed over the entire outer surface of the heat transfer pipe body 213Aa.

The finless heat transfer pipe 213B has the same configuration as the second heat transfer pipe 13 described in the first embodiment. That is, the finless heat transfer pipe 213B is formed in a tubular shape having a circular cross-sectional contour and no needle-shaped fin 213Ab is formed thereon. Note that, as the finless heat transfer pipe 213B, a pipe formed of the same metal as the finned heat transfer pipe 213A may be used and a pipe formed of a different metal from the finned heat transfer pipe 213A may also be used.

Therefore, according to the second embodiment described above, particularly, the finned heat transfer pipe 213A includes the needle-shaped fins 213Ab and thus a liquid film formed on a surface of the finned heat transfer pipe 213A can be made thin. Therefore, the thermal resistance can be made small and the heat transfer coefficient can be made large. Furthermore, since only the second heat transfer pipes 213 disposed above the second heat transfer pipe group 211 are the finned heat transfer pipes 213A and the finless heat transfer pipes 213B are disposed below the finned heat transfer pipes 213A, liquid films on the second heat transfer pipes 213 (finless heat transfer pipes 213B) that are disposed at a lower side and are included in the second heat transfer pipe group 211 can be restrained from being made excessively thin such that heat transfer pipe surfaces are exposed. Therefore, it is possible to suppress a decrease in heat transfer performance in the second heat transfer pipe group 211.

Third Embodiment

Next, an evaporator and a refrigeration machine in a third embodiment of the invention will be described with reference to the drawings. Note that, the third embodiment is different from the first embodiment in a point that a third heat transfer pipe group 316 is provided in addition to the first heat transfer pipe group 10 and the second heat transfer pipe group 11 in the first embodiment. Therefore, the same parts as those in the first embodiment will be given the same reference numerals. In addition, detailed description of the entire configuration of a refrigeration machine 300 in the third embodiment will be omitted.

Figure 7:
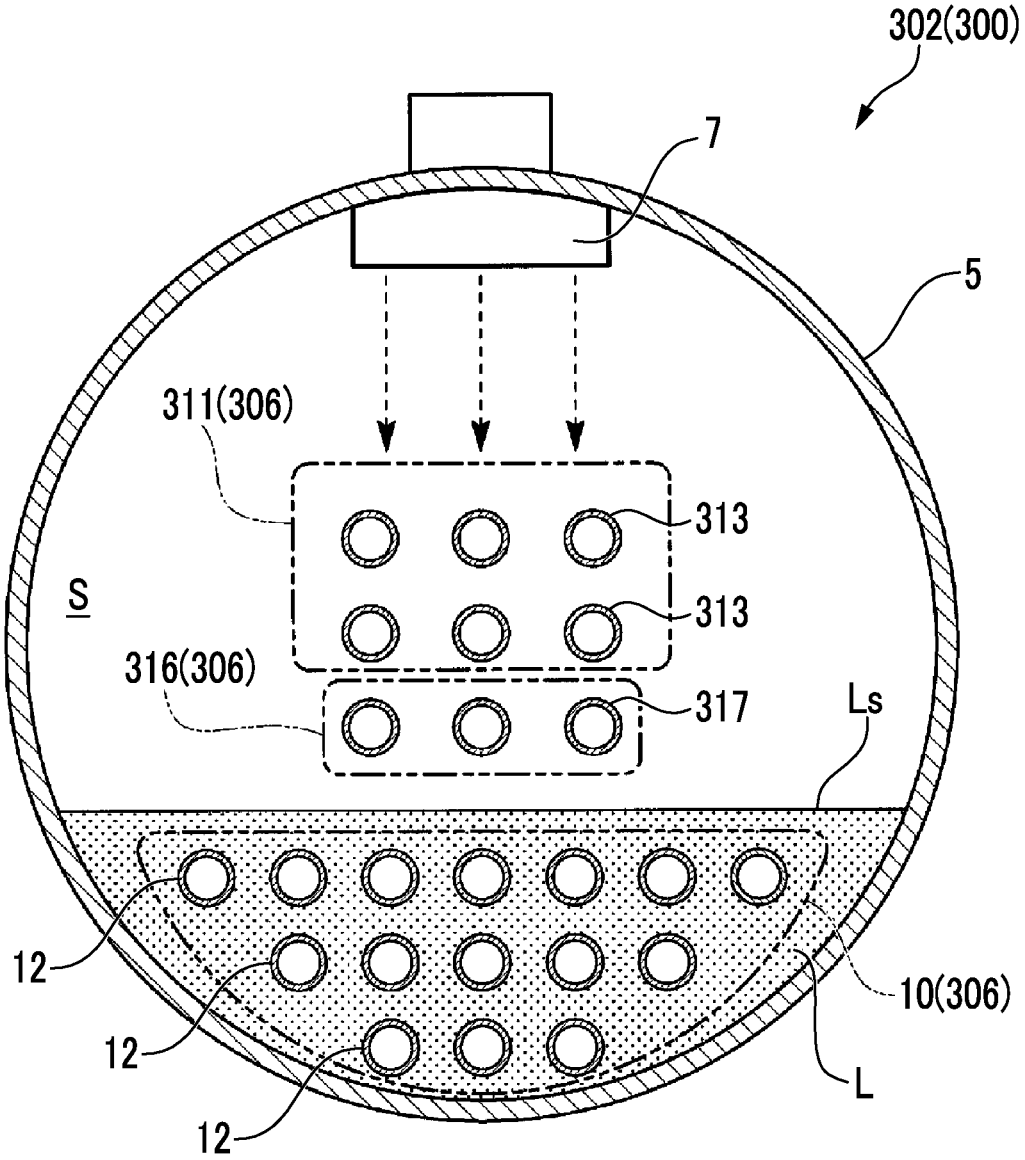
FIG. 7 is a sectional view showing an evaporator in a third embodiment of the invention and corresponds to FIG. 2.

FIG. 7 is a sectional view showing the evaporator in the third embodiment of the invention and corresponds to FIG. 2.

As shown in FIG. 7, an evaporator 302 includes the casing 5, a heat transfer pipe group 306, and the refrigerant supply section 7.

The casing 5 forms a sealed space covering the heat transfer pipe group 306 and the refrigerant supply section 7, as with the casing 5 in the first embodiment. A refrigerant can be stored in the space S inside the casing 5. The casing 5 is formed with a discharge port (not shown) for discharging evaporated refrigerant to the outside to send the refrigerant toward the compressor 1, an opening (not shown) through which heat transfer pipes (heat transfer pipe group 306) and a pipe for supplying a fluid to be cooled communicate with each other, and an opening (not shown) through which the refrigerant supply section 7 and a pipe for supplying a liquid refrigerant communicate with each other.

The heat transfer pipe group 306 includes the first heat transfer pipe group 10, a second heat transfer pipe group 311, and the third heat transfer pipe group 316.

The first heat transfer pipe group 10 has the same configuration as the first heat transfer pipe group 10 in the first embodiment and is composed of the plurality of first heat transfer pipes 12. The first heat transfer pipes 12 are provided in a lower portion of the space S in the casing 5 and each of the first heat transfer pipes 12 extends in the longitudinal direction (front-to-back direction of paper surface of FIG. 7) of the casing 5 formed in a tubular shape. Inside the first heat transfer pipes 12, liquid to be cooled that exchanges heat with the liquid refrigerant L flows. The first heat transfer pipes 12 constituting the first heat transfer pipe group 10 are provided to be immersed in the liquid refrigerant L. The first heat transfer pipes 12 are disposed at intervals over the entire region in the liquid refrigerant L, the first heat transfer pipes 12 being disposed at substantially equal intervals. Regarding the first heat transfer pipe group 10 described in the third embodiment as well, as with the first embodiment, the first heat transfer pipes 12 are arranged in three rows in a vertical direction with the numbers of first heat transfer pipes 12 in respective rows being seven, five, and three in order from the top. The number of rows, the number of columns, the pitch, and the arrangement (lattice arrangement/staggered arrangement) of the first heat transfer pipes 12 are not limited to the above number.

The first heat transfer pipe 12 is formed of, copper or an alloy containing copper, which is excellent in heat transfer performance, for example. In addition, as with the first embodiment, the first heat transfer pipe 12 includes the boiling heat transfer surface 14 (refer to FIG. 3) on an outer surface side thereof.

The second heat transfer pipe group 311 is composed of a plurality of second heat transfer pipes 313. The plurality of second heat transfer pipes 313 can be formed of the same metal as the first heat transfer pipes 12. Regarding the second heat transfer pipe group 311 described in the second embodiment, two rows of three second heat transfer pipes 313 arranged at intervals in the horizontal direction are provided in the vertical direction. Note that, regarding the second heat transfer pipe group 311 in the third embodiment, as with the second embodiment, the finned heat transfer pipe 213A (refer to FIG. 6) may be disposed at an upper row (or uppermost row) from among a plurality of rows. The number of rows, the number of columns, the pitch, and the arrangement (lattice arrangement/staggered arrangement) of the second heat transfer pipes 313 are not limited to the above number.

The third heat transfer pipe group 316 is disposed between the first heat transfer pipe group 10 and the second heat transfer pipe group 311. The third heat transfer pipe group 316 is composed of a plurality of third heat transfer pipes 317. The third heat transfer pipe group 316 described in the third embodiment is composed of three third heat transfer pipes 317 arranged at intervals in the horizontal direction. That is, the third heat transfer pipe group 316 includes one row of third heat transfer pipes 317. The third heat transfer pipes 317 are disposed vertically below the second heat transfer pipes 313 in the lowermost row of the second heat transfer pipe group 311 described above, respectively. In other words, the third heat transfer pipes 317 described in the third embodiment are disposed near the center of the casing 5 in a cross section shown in FIG. 7 and are disposed to be separate from the casing 5 in the horizontal direction intersecting a direction in which the third heat transfer pipes 317 extend. In addition, the third heat transfer pipe 317 constituting the third heat transfer pipe group 316 includes a boiling heat transfer surface (refer to FIG. 3) on an outer surface side thereof, as with the first heat transfer pipe 12.

Normally, as with the second heat transfer pipe group 311, the third heat transfer pipe group 316 is disposed above the liquid level Ls of the liquid refrigerant L accumulated in the lower portion of the casing 5 and functions as a liquid film-type evaporator. Meanwhile, in a case where the amount of liquid refrigerant L not evaporated in the second heat transfer pipe group 311 is increased and the liquid level Ls of the liquid refrigerant L is raised, the third heat transfer pipe group 316 is immersed in the liquid refrigerant L and the second heat transfer pipes 313 of the second heat transfer pipe group 311 are not immersed in the liquid refrigerant L. Note that, the number of rows of the third heat transfer pipes 317 included in the third heat transfer pipe group 316 is not limited to one and a plurality of rows of the third heat transfer pipes 317 may be provided. In addition, the number of rows of the third heat transfer pipes 317 included in the third heat transfer pipe group 316 may be set in accordance with the range of fluctuation of the liquid level Ls of the liquid refrigerant L.

Therefore, according to the third embodiment described above, normally, it is possible to cause the third heat transfer pipes 317 to function as heat transfer pipes of a liquid film-type evaporator together with the second heat transfer pipes 313. At this time, with the boiling heat transfer surfaces 14 of the third heat transfer pipes 317, it is possible to improve the heat transfer pipe surfaces in heat transfer coefficient in comparison with a case where no boiling heat transfer surface 14 is provided. Therefore, performance as a liquid film-type evaporator can be improved.

In addition, even if the amount of liquid refrigerant L not evaporated in the second heat transfer pipe group 311 is increased and the liquid level Ls of the liquid refrigerant L in the casing 5 is raised, the third heat transfer pipe group 316 including the boiling heat transfer surfaces 14 is immersed in the liquid refrigerant L and with the third heat transfer pipes 317 immersed in the liquid refrigerant L, the same heat exchange performance as the heat exchange performance of the first heat transfer pipes 12 can be achieved. That is, heat exchange performance can be improved in comparison with a case where the third heat transfer pipes 317 include no boiling heat transfer surface 14.

The invention is not limited to the above-described embodiments, and the invention includes various modifications of the embodiments described above insofar as the modifications do not depart from the spirit of the invention. That is, specific shapes, configurations, and the like in the embodiments are merely examples that can be appropriately changed and a refrigerating cycle and the type of constituent device thereof do not matter as long as a refrigeration machine includes the evaporator 2.

In addition, the shapes of the evaporators 2, 202, and 302 are not limited to those described above. For example, the cross-sectional contour of the casing 5 or a heat transfer pipe is not limited to a circular shape.

In the first embodiment, a case where the first heat transfer pipe 12 includes the boiling heat transfer surface 14 has been described. However, as the first heat transfer pipe 12, a so-called bare pipe including no boiling heat transfer surface 14 as with the second heat transfer pipe 13 may also be used.

Meanwhile, in the first embodiment, a case where the second heat transfer pipe 13 includes no boiling heat transfer surface 14 has been described. However, the second heat transfer pipe 13 may include the boiling heat transfer surface 14 as with the first heat transfer pipe 12. In other words, all of the second heat transfer pipes 13 of the second heat transfer pipe group 11 constituting a liquid film-type evaporator may be boiling heat transfer pipes including the boiling heat transfer surfaces 14.

REFERENCE SIGNS LIST

1 compressor
2, 202, 302 evaporator
3 expansion valve
4 condenser
5 casing
6, 206, 306 heat transfer pipe group
7 refrigerant supply section
10 first heat transfer pipe group
11, 211, 311 second heat transfer pipe group
12 first heat transfer pipe
13, 213, 313 second heat transfer pipe

14 boiling heat transfer surface
213A finned heat transfer pipe
213B finless heat transfer pipe
213Aa heat transfer pipe body
213Ab needle-shaped fin
316 third heat transfer pipe group
317 third heat transfer pipe
100, 200, 300 refrigeration machine

The invention claimed is:

1. An evaporator comprising:

a casing in which a refrigerant is stored a discharge port that is provided in an upper part of the casing and discharges an evaporated refrigerant to an outside;

a refrigerant supply section that supplies, from an upper portion of a space in the casing, a refrigerant from the outside;

a first heat transfer pipe group that is composed of a plurality of first heat transfer pipes through which a liquid to be cooled flows, the plurality of first heat transfer pipes that are disposed so as to be immersed in the refrigerant which is accumulated in a lower portion of the space in the casing, and that are disposed at equal intervals in the liquid refrigerant which is accumulated in the lower portion;

a second heat transfer pipe group that is disposed in the space in the casing at a position below the refrigerant supply section and above a liquid level of the refrigerant and is composed of a plurality of second heat transfer pipes through which the liquid to be flows; and a third heat transfer pipe group composed of a plurality of third heat transfer pipes between the first heat transfer pipe group and the second heat transfer pipe group, wherein the first heat transfer pipe group and the third heat transfer pipes include boiling heat transfer surfaces on outer surface sides thereof.

2. The evaporator according to claim 1, wherein the second heat transfer pipe group includes a plurality of needle-shaped fins on an outer surface of the second heat transfer pipe disposed at an upper portion from among the plurality of second heat transfer pipes.

3. A refrigeration machine comprising:

the evaporator according to claim 1.

4. A refrigeration machine comprising:

the evaporator according to claim 2.

* * * * *